US005903986A

United States Patent [19]

Parker

[11] Patent Number: 5,903,986

[45] Date of Patent: May 18, 1999

[54] SNOW PLOW WITH SIDE GATE

[76] Inventor: Peter M. Parker, 314 Sixth Ave., Baraboo, Wis. 53913

[21] Appl. No.: 08/786,167

[22] Filed: Jan. 21, 1997

[51] Int. Cl.[6] ..... E01H 5/00

[52] U.S. Cl. ..... 37/281; 172/815

[58] Field of Search ..... 37/281, 274; 172/815

[56] References Cited

U.S. PATENT DOCUMENTS

| | | | |
|---|---|---|---|
| 1,190,832 | 7/1916 | Wheeler | 37/281 X |
| 1,889,667 | 11/1932 | Klauer | 37/281 X |
| 2,763,944 | 9/1956 | Magee et al. . | |
| 2,988,831 | 6/1961 | Burns . | |
| 3,055,126 | 9/1962 | Emhof . | |
| 3,407,519 | 10/1968 | Batko . | |
| 3,422,552 | 1/1969 | Gabel . | |
| 3,845,517 | 11/1974 | Harris | 37/281 X |
| 4,077,139 | 3/1978 | Fagervold et al. | 37/281 X |
| 4,208,812 | 6/1980 | Brownly . | |
| 4,217,707 | 8/1980 | Karlsson . | |
| 4,446,639 | 5/1984 | Bohn . | |
| 4,614,048 | 9/1986 | Melby | 172/815 X |
| 4,707,936 | 11/1987 | Steinhoff . | |
| 5,375,349 | 12/1994 | Jochim | 37/281 X |
| 5,758,728 | 6/1998 | Ragule | 37/281 X |

FOREIGN PATENT DOCUMENTS

| | | | |
|---|---|---|---|
| 753817 | 3/1967 | Canada | 37/281 |
| 140139 | 5/1985 | European Pat. Off. | 37/281 |
| 787573 | 12/1980 | U.S.S.R. | 172/815 |

OTHER PUBLICATIONS

The Gledhill Road Machinery Company, Gledhill Snow Plows, specification sheet for Gledhill Model "M/PR" Series, Date Unknown.

Little Falls Machine, Inc., specification sheet for Falls Power Reversible Plows, Date Unknown.

Universal Truck Equipment, specification sheet for Universal's BH–PNL Power Reversible Snowplows and Universal's Pin and Loop Snowplow, Date Unknown.

*Primary Examiner*—Christopher J. Novosad

*Attorney, Agent, or Firm*—Quarles & Brady LLP

[57] ABSTRACT

A snow plow blade includes a forward extending gate to catch snow rolling off the snow plow blade such as may form a snow ridge blocking drives, crosswalks and fire hydrants. The gate follows a trajectory forward from the curb edge of the plow blade to prevent catching the extension gate with the curb regardless of angulation of the plow blade or the degree of extension. The extension gate extension mechanism may be completely attached to the rear surface of the plow blade to operate independently of angulation of the plow blade.

7 Claims, 4 Drawing Sheets

SNOW PLOW WITH SIDE GATE

BACKGROUND OF THE INVENTION

The invention relates generally to snow plows for mounting on trucks and the like and specifically to a snow plow having a side gate controlling the off-flow of snow into abutting streets and driveways.

It is common practice to remove snow from streets through the use of an angled snow plow blade which channels snow from an area in front of a truck toward a curb side of the blade where the snow is deposited as a ridge running along the curb.

The angled plow, by spreading the removed snow in the ridge at the curb eliminates the need to haul the snow away. The snow ridge so formed at the side of the street is generally unobjectionable except where it blocks off adjoining streets, private drives or cross walks. The snow ridge may also cover fire hydrants. In these cases, time consuming and expensive additional steps must be taken to clear the blockage.

In order to prevent the formation of the snow ridge at certain points along the path of the snow plow blade, it is known to install a gate at the trailing edge of the snow plow blade. The gate may be closed to momentarily retain snow on the snow plow blade, stopping the formation of the offending snow ridge that may block streets or walks.

In one such approach, exemplified by U.S. Pat. No. 3,422,552, a side gate may be extended forward from the trailing edge of the main plow blade. Forward extension of this retaining gate allows the gate to immediately stop the small amount of snow flowing off the blade but to progressively handle the greater accumulation of snow over time as the side gate continues to extend forward. Likewise, as the gate is retracted in a rearward direction, the gradual retraction may evenly distribute the retained snow back into the ridge without dropping of a large block of snow in one location.

This forwardly extending side gate is not easily adapted to existing plow designs because it requires substantial additional mechanism to the side of the truck cab. Further, the side gate does not readily allow changes in angulation of the plow blade as may be required to adjust the plow to various snowfall conditions. Also, the tie rod 72 mounted to the front of the snowplow blade in U.S. Pat. No. 3,422,522 will break if the blade tips forward. Modern snowplow blades are designed to tip when they encounter road hazards such as utility hole covers, to avoid damage to the blade.

BRIEF SUMMARY OF THE INVENTION

The present invention provides a snow plow with a forwardly extending side gate such as may be readily adapted to existing plow designs and that does not interfere with angulation of the plow blade. Generally, the side gate extends in an arc of lesser radius than the angulation radius of the main plow blade so that the gate, even though it is at the edge of the plow blade, at no time extends outside the curb edge of the plow blade. For this reason, it cannot catch at obstructions outside the area of the plow blade regardless of the angulation of the plow blade. The extension gate may be attached to arms that swing from pivot points attached to the plow or the plow mounting bracket eliminating the need for additional structure that must be attached to the truck cab and such as would interfere with attaching and removing the plow blade from the truck.

Specifically, the invention provides a snow plow having a mounting frame with a rear portion adapted to attach to the front of a vehicle and a forward portion supporting a coupling providing a pivot point about a substantially vertical axis. A plow blade, having a curb edge normally positioned adjacent to a street curb during plowing, is attached to the coupling to rotate about the pivot point. An extension gate having a leading and trailing edge is attached to a guide assembly which is in turn attached to one of the mounting frame and the plow blade to holds the extension gate so that it may slidably extend forward from the plow blade at the curb edge of the plow blade, its leading edge following a radius substantially no greater than the distance between the pivot point and the curb edge of the snow plow blade.

Thus, it is one object of the invention to provide an extension gate extending from the curb edge of the plow blade to momentarily stop the flow of snow from the plow blade (as the blade crosses driveways and the like) where the leading edge of the gate stays within the curb edge of the plow blade regardless of blade angulation or gate extension. In this way, the gate cannot catch or interfere with the curb and the plow operator need only be concerned with the location of the curb edge of the plow blade and not with the exact location of the gate.

The guide assembly may include a swing arm attached at a hinge end to one of the plow blade and mounting assembly to extend behind the plow blade toward the curb edge of the plow blade. The extension gate is affixed to the outer end of the arm to extend forward therefrom. The pivoting of the swing arm about the hinge end causes extension of the extension gate forward from the curb edge of the plow blade. The extension gate may be arcuate along the path between its leading and trailing edge.

Thus, it is another object of the invention to provide for an extension gate that may be attached directly to the plow and which does not require additional connections to the cab of the vehicle such as may make it difficult to attach and remove the plow to or from the vehicle.

It is another object of the invention to provide an extension gate for a snow plow that may be used with conventional snow plow blades. The use of the pivoting arm structure allows the extension gate to be attached in a compact manner to the space behind the snow plow blade without interfering with angulation of the snow plow blade.

The foregoing and other objects and advantages of the invention will appear from the following description. In this description reference is made to the accompanying drawings which form a part hereof and in which there is shown by way of illustration a preferred embodiment of the invention. Such embodiment does not necessarily represent the full scope of the invention, however, and reference must be made therefore to the claims for interpreting the scope of the invention.

DETAILED DESCRIPTION OF THE INVENTION

Figure 1:
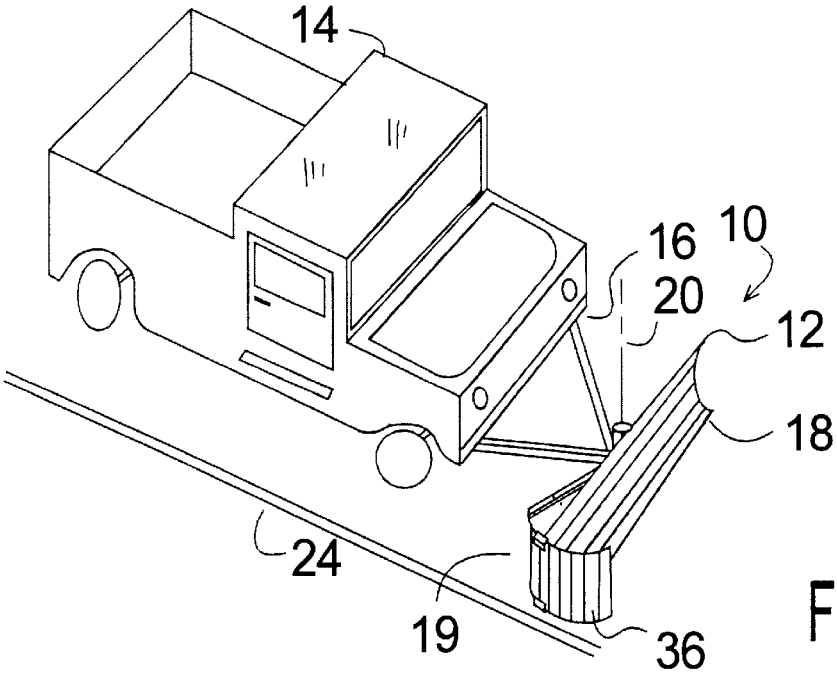
FIG. 1 is a perspective view of a truck having the snow plow of the present invention attached at its front end showing the extension gate in an extended position.

Referring to FIG. 1, a snow plow 10 of the present invention includes a plow blade 12 attached to the front of a truck 14 by means of a mounting frame 16. The plow blade 12 generally extends horizontally across the width of the truck 14 so as to clear a passage in front of the truck 14 as the truck 14 drives forward.

The plow blade 12 has a hardened lower edge 18 which normally runs over the surface of the street with a curb edge 19 of the blade 12 positioned close to a curb 24 of the street. The front surface of the blade 12 curves upward in a C-shaped cross section opening forward such as prevents the snow pushed by the plow blade 12 from climbing over the top edge of the plow blade 12.

Figure 2:
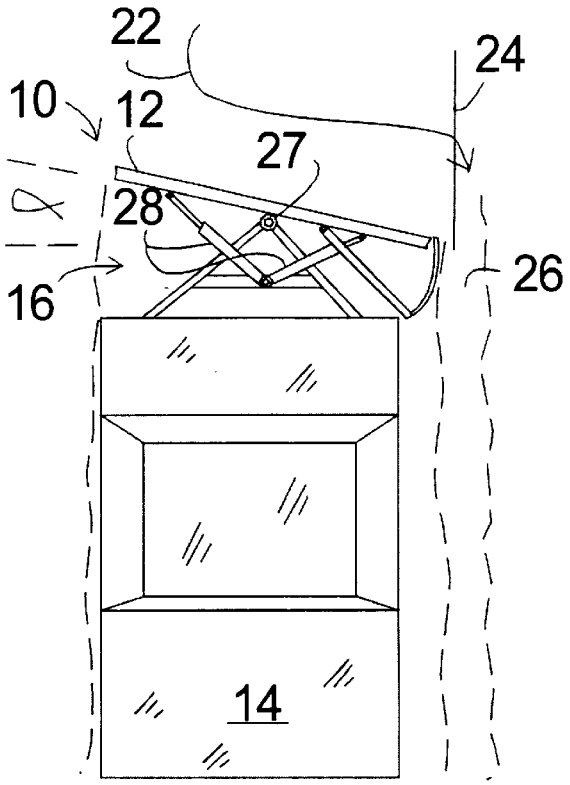
FIG. 2 is a top plan view of the truck and snow plow of FIG. 1 showing the passage of snow off the plow blade into a snow ridge when the extension gate is retracted.

Referring to FIGS. 1 and 2, the plow blade 12 will normally be angled about a vertical pivot axis 20 with the curb edge 19 angled back so that snow collected by the blade 12 will flow off the blade along a trajectory 22 toward the curb 24 where it is deposited as a snow ridge 26 at the curb 24. The pivot axis 20 is provided by a pivoting coupling 27 which permits angulation of the plow blade 12 by an arbitrary angle comporting with the current snow conditions and adjusted by the operator. The adjustment of the angulation may be performed by means of a pair of hydraulic cylinders 28 attached at one end to a rigid portion of the mounting frame 16 and attached at the other ends to points on the rear side of the plow blade 12 removed from its center line. As is well understood in the art, extension and contraction of opposite cylinders 28 rotates the plow blade 12 about the coupling 27.

Figure 3:
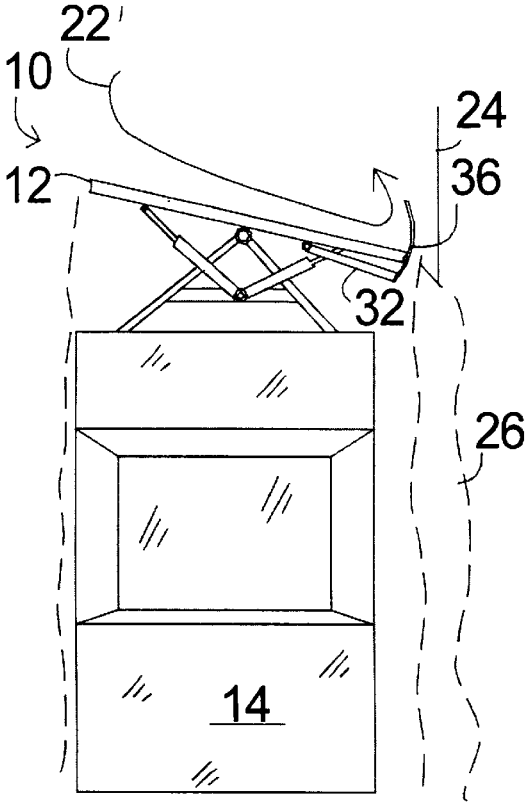
FIG. 3 is a figure similar to that of FIG. 2 showing the stopping of the snow flowing off of the plow blade into a snow ridge during the forward extension of the extension gate.
Figure 4:
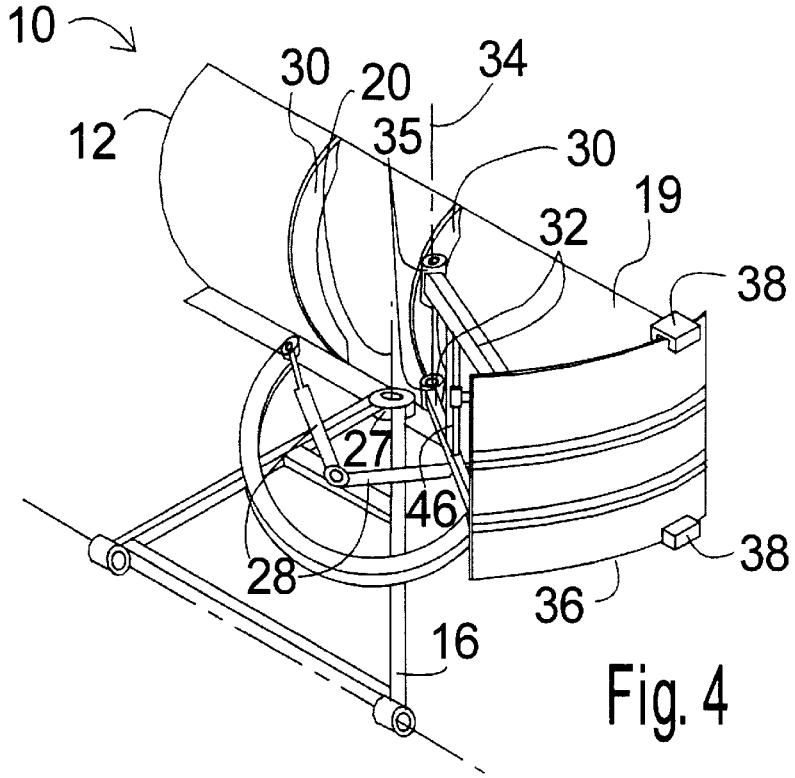
FIG. 4 is a perspective rear view of the plow blade of FIGS. 1 through 3 showing the attachment of the extension gate by means of swing arms to the rear of the plow blade and showing the unencumbered angulation mechanism of the plow blade.
Figure 5:
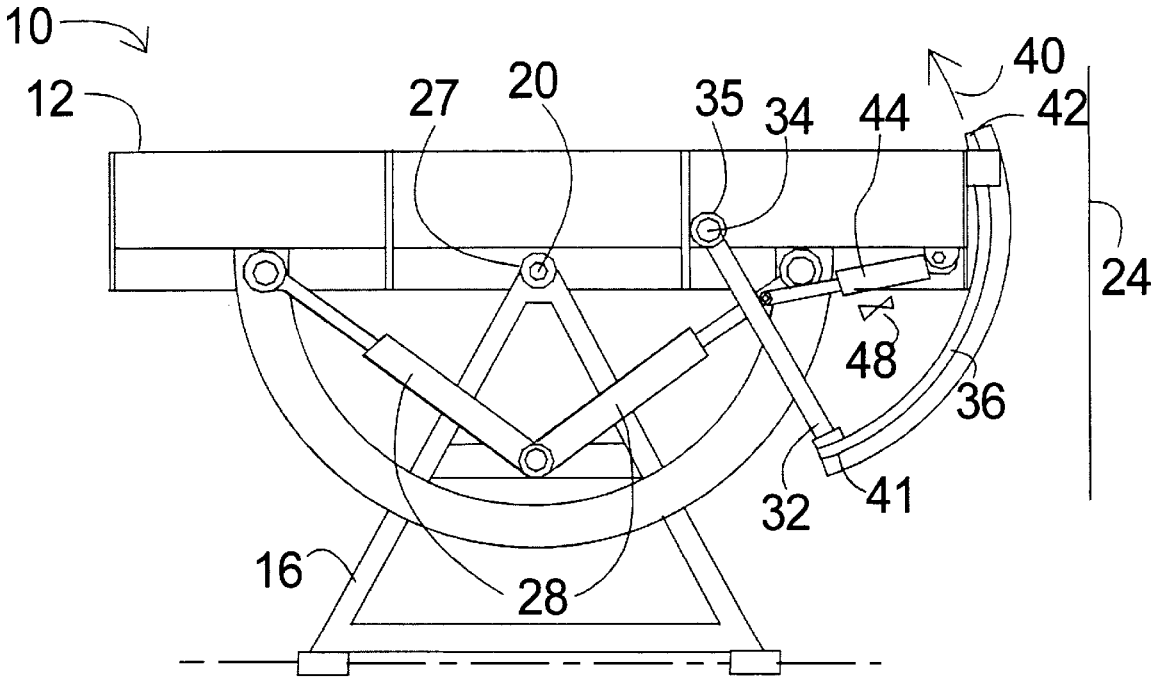
FIG. 5 is a plan view of the plow blade of FIG. 4 showing the curved trajectory of the leading edge of the extension gate with extension.

Referring now to FIGS. 3, 4 and 5, the rear surface of the plow blade 12 includes a first and second stiffening rib 30 normally intended to resist deflection of the plow blade 12 (such as would tend to unroll the C-cross section of the blade) under the force of the deflected snow. Attached to one rib 30, positioned toward the curb edge 19 of the plow blade 12 are laterally extending hinged swing arms 32 which pivot about a vertical axis 34 on hinges 35 attached to the rib 30.

The swing arms 32 attach at their other end to the trailing edge 41 of an arcuate extension gate 36 having a generally rectangular periphery and being of height substantially equal to that of the plow blade 12. The extension gate 36 attaches to the swing arms to extend therefrom at a right angle forward along the curb edge 19 of the plow blade 12. Channel guides 38, attached to the top and bottom of the curb edge 19 of the plow blade 12, provide channels through which the extension gate 36 may be slidably received and which support the extension gate 36 against lateral movement away from the curb edge 19 of the plow blade 12 under the force of snow.

Rotation of the swing arms 32 about the hinge axis 34 and toward the plow blade 12 causes an extension of the extension gate 36 through the guides 38 past the plow blade 12 to its front side. As shown in FIG. 3, the extended gate 36 catches snow which would normally slide off the plow blade 12 to form the snow ridge 26 thus causing the trajectory 22' of the snow to curve backward on itself. The extension gate 36 curves inward along an arc around the hinge axis 34 and this arc provides a diversion rather than a blockage of this trajectory 22' to resist clumping of the snow against the gate 36.

The trajectory 40 of the leading edge 42 of the extension gate 36 as the gate 36 extends, also follows an arc, defined by the length of the swing arms 32. The arc of this trajectory intentionally has a radius less than radius of motion of the curb edge 19 of the plow blade 12 as it pivots about pivot point 20 and typically will have a radius of less than half the width of the snow plow blade 12. Thus, as the extension gate 36 extends forward in front of the plow blade 12, the gate at all times remains within the line of the curb 24 when the curb edge 19 of a plow blade 12 is inside the curb 24. For this reason, the operator of the snow plow need not be concerned about the extension gate 36 catching on or interfering with the curb 24 regardless of the angulation of the plow blade about the axis 20 or the degree of extension of the extension gate, but the operator may instead concentrate on positioning only the curb edge 19 of the plow blade 12.

Movement of the swing arms 32 is controlled by a swing arm cylinder 44 which attaches, at one end, to the rear of the plow blade 12 near its curb edge 19 and at its other end to the swing arms 32 by means of a cross brace 46 extending vertically between the swing arms 32. Contraction of the cylinder 44 indicated by arrows 48 causes the swing arms 32 to pivot forward extending the extension gate 36. Conversely expansion of the cylinder 44 causes a retraction of the extension gate 36. The control of the hydraulic cylinders 28 and 44 may be by means of hydraulic control valves in the cab of the truck 14 operated by the plow operator as will be understood to those of ordinary skill in the art.

Because the mechanism of the swing arms 32 and cylinder 44, allowing for extension and retraction of the extension gate 36, is wholly attached to the plow blade 12, angulation of the plow blade 12 by means of cylinders 28 does not affect the degree of the extension of the extension gate 36. Likewise a change in the angulation of the plow blade 12 does not cause any portion of the extension gate 36 to extend further outward toward the curb 24 than the curb edge of the plow blade 12 as a result of the curved trajectory 40 of the extension gate 36 and its arcuate shape.

Figure 6:
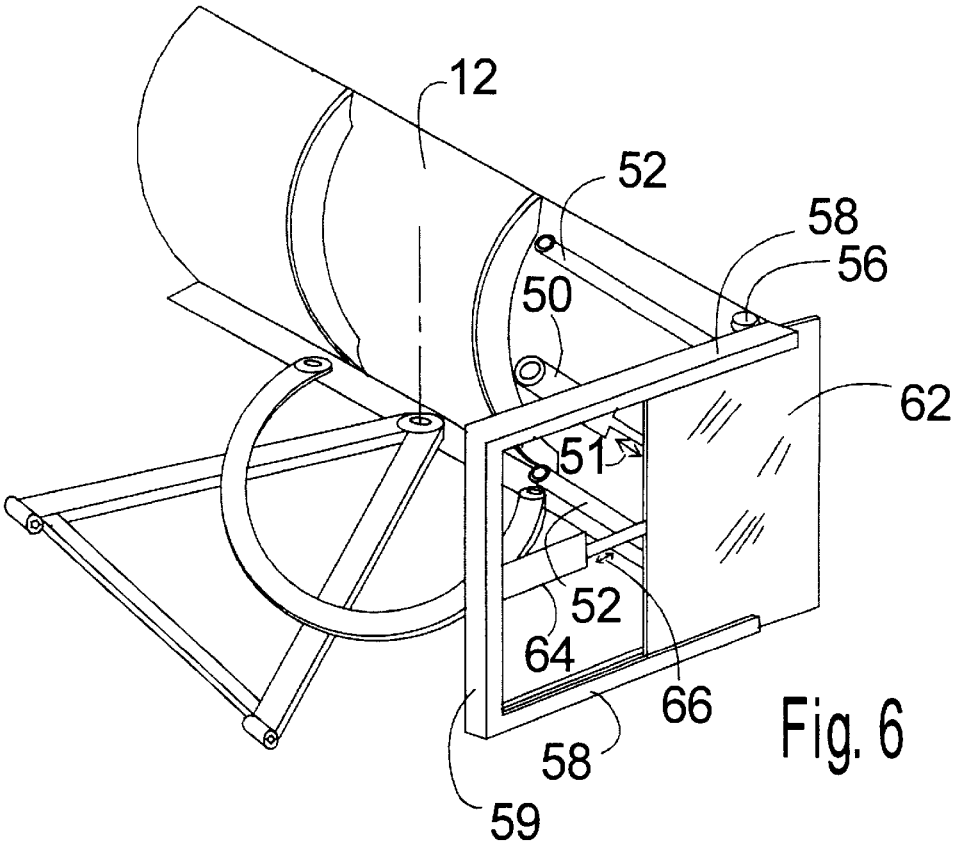
FIG. 6 is a perspective rear view of a plow blade with a second embodiment of the guide assembly of the invention.
Figure 7:
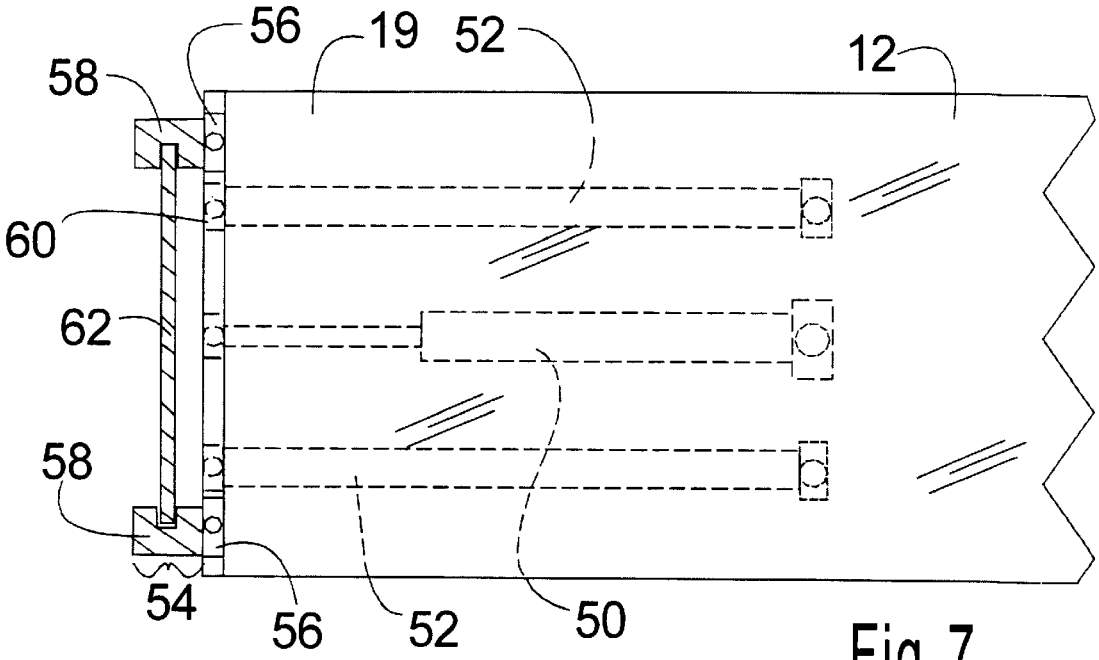
FIG. 7 is a front view of the plow blade and guide assembly of FIG. 6, with certain portions hidden by the plow blade shown in dotted lines.

In a second embodiment (FIGS. 6–9), the extension gate is substantially planar and is pivotably joined to a plow blade having a mounting frame as described hereinbefore. The plow blade angle is adjusted as previously described. For simplicity, the plow blade angulation mechanism is not shown in FIGS. 6–9. Referring now to FIGS. 6 and 7, pivotally attached to the rear surface of the plow blade 12, and positioned toward the curb edge 19 of the plow blade 12 is a first hydraulic cylinder 50 which moves along linear axis 51. The control of the hydraulic cylinders herein may be by means of hydraulic control valves in the cab of the truck 14 operated by the plow operator as will be understood to those of ordinary skill in the art. Alternatively, the cylinders can be operated by electrical, mechanical, or other suitable actuator. Also attached to the rear surface of the plow blade 12 are laterally extending hinged swing arms 52 which pivot about the same point as the cylinder 50. The cylinder 50 and the swing arms 52 are attached at their second ends to a guide assembly 54. The guide assembly 54 is movably attached to the plow blade 12 to permit independent angular adjustment of the plow blade 12 and the guide assembly 54. Attachment is preferably made by upper and lower ball joints 56. The guide assembly 54 includes upper and lower channel guides 58 at the top and bottom of the guide assembly 54. The channel guides 58 which can include channels to slidably engage the extension gate 36 are like those described above, except that substantially the entire length of the extension gate 36 can engage the channel guides 58. The guides 58 are maintained at a fixed spaced apart distance by a backstop 59 extending between the guides 58. The upper and lower channel guides 58 can be attached to the plow blade 12 through the ball joints 56. Between the upper and lower channel guides 58 is a mount 60 to which the cylinder 50 and the swing arms 52 pivotally connect (see FIG. 7).

Provided in the channel guides 58 of the guide assembly 54 is an extension gate 62 having a leading edge and a trailing edge. The extension gate 62 is preferably substantially planar. Movement of the extension gate 62 is controlled by a second hydraulic cylinder 64 fixedly mounted to the backstop 59 and to the extension gate 62. The second cylinder 64 joins the trailing edge of the extension gate 62 to the backstop 59 such that extension of the cylinder 64 in the linear axis shown by arrows 66 causes the extension gate 62 to slide forward to partially or completely block the C-cross section of the plow blade 12 at the curb edge 19. Conversely, contraction of the cylinder 64 along the same axis 66 causes a retraction of the extension gate 62 to a position behind and to the side of the plow blade 12.

Figure 8:
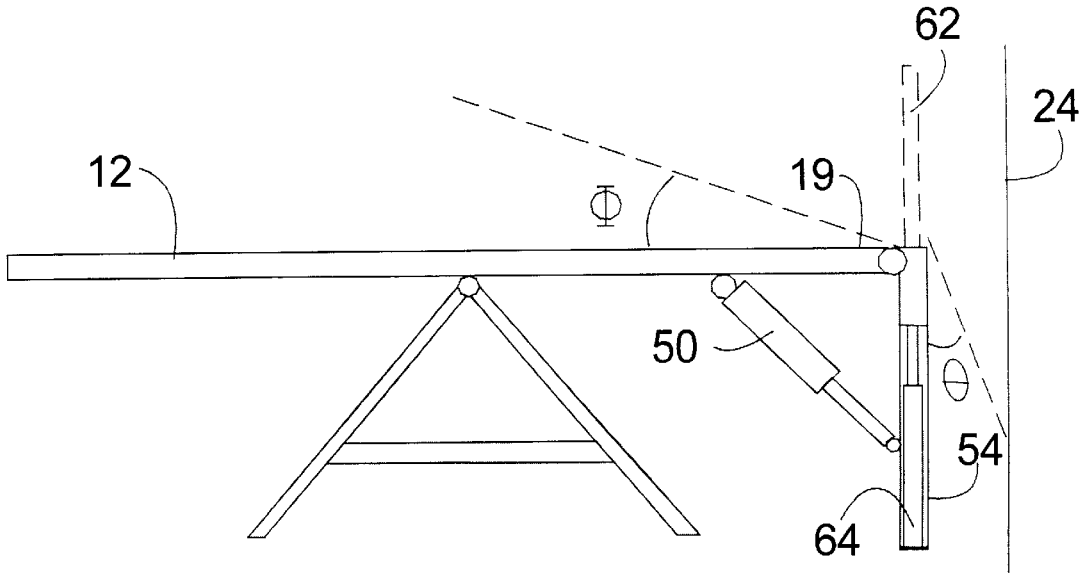
FIG. 8 shows the angular adjustment of the plow blade and guide assembly relative to one another.
Figure 9:
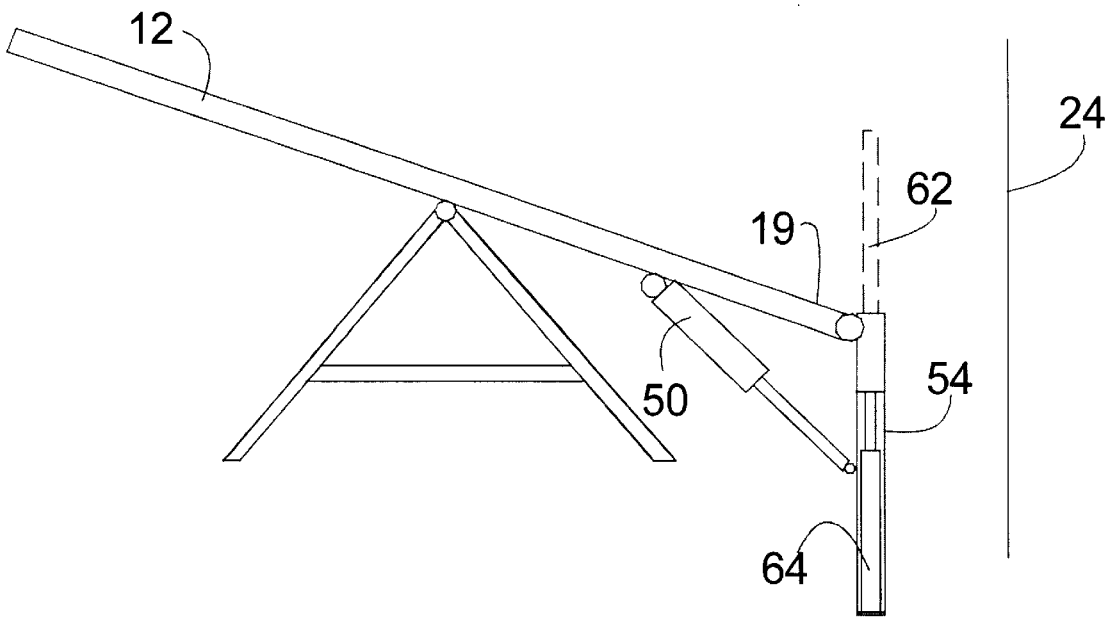
FIG. 9 shows the resultant positions of plow blade and guide assembly after angular adjustment.

In this embodiment, it is desired to keep the guide assembly 54 moving forward in a direction parallel to the direction of travel and parallel to the curb. To achieve this, the two cylinders 50, 64 can be coordinately operated, as is shown in FIGS. 8 and 9, such that when the angulation of the plow blade 12 about the vertical pivot axis is adjusted by an angle $\Phi$, the cylinder pivotally connected between the plow blade 12 and the guide assembly is adjusted by a comparable angle $\theta$. Preferably, $\theta$ and $\Phi$ are identical, but can differ from each other by about five or ten degrees. It is preferred that the mechanism for adjusting the plow blade angulation and the guide assembly be coordinately operated. FIG. 9 shows that as a result of such an angulation, the guide assembly 54 remains generally parallel to the curb and cannot interfere with operation of the plow.

A particular advantage of this embodiment is that it is structurally simpler than the first embodiment.

The above description has been of two preferred embodiments of the present invention. It will occur to those that practice the art that many modifications may be made without departing from the spirit and scope of the invention. In order to apprise the public of the various embodiments that may fall within the scope of the invention the following claims are made.

I claim:

1. A snow plow comprising:

a mounting frame having a rear portion adapted to attach to a front of a vehicle and a front portion supporting a coupling providing a pivot point about a substantially vertical axis;

a plow blade having a curb edge normally positioned adjacent to a street curb during plowing, the plow blade attached to the coupling to rotate about the pivot point;

an extension gate having a leading and a trailing edge;

a guide assembly, attached to one of the mounting frame and the plow blade and holding the extension gate to slidably extend forward from the plow blade at the curb edge of the plow blade, the leading edge of the extension gate following a radius substantially no greater than the distance between the pivot point and the curb edge of the plow blade in its extension; and a swing arm attached at a hinge end to one of the plow blade and mounting frame to extend behind the plow blade toward the curb edge;

wherein the extension gate is affixed to an outer end of the swing arm to extend forward therefrom, the pivoting of the swing arm about the hinge end causing extension of the extension gate forward from the curb edge of the plow blade.

2. The snow plow as recited in claim 1 including an actuator for moving the swing arm, wherein the actuator is attached between the plow blade and the swing arm so that the swing arm maintains a fixed angle to the plow blade with rotation of the plow blade but no movement of the actuator.

3. The snow plow as recited in claim 1 wherein the extension gate is arcuate in dimension extending between its leading and trailing edge.

4. The snow plow as recited in claim 3 wherein a radius of curvature of the arc of the extension gate is equal to the radius followed by the extension gate in its extension by the guide assembly.

5. The snow plow as recited in claim 1 wherein the guide assembly also includes a channel affixed to the curb edge of the plow blade, the channel slidably receiving and retaining the extension gate against the curb edge of the plow blade during extension of the extension gate.

6. A snow plow comprising:

a mounting frame having a rear portion adapted to attach to a front of a vehicle and a front portion supporting a coupling providing a pivot point about a substantially vertical axis;

a plow blade having a curb edge normally positioned adjacent to a street curb during plowing, the plow blade attached to the coupling to rotate about the pivot point;

an extension gate having a leading and a trailing edge, the extension gate is substantially planar in dimension extending between its leading and trailing edge;

a guide assembly attached to one of the mounting frame and the plow blade, whereby no further attachment to the vehicle is necessary, and holding the extension gate to slidably extend forward from the plow blade at the curb edge of the plow blade wherein the guide assembly is pivotally attached to the curb edge of the plow blade for maintaining the guide assembly at a desired angle in response to angulation of the plow blade; and a first actuator attached to the plow blade and the extension gate for maintaining the extension gate in parallel with a street curb.

7. The snow plow as recited in claim 6 further comprising a second actuator for reciprocally moving the extension gate.

* * * * *